United States Patent [19]

Berokoff

[11] Patent Number: 4,600,190

[45] Date of Patent: Jul. 15, 1986

[54] EXERCISING DEVICE

[76] Inventor: Andrew J. Berokoff, 7761 Bowen Dr., Whittier, Calif. 90602

[21] Appl. No.: 674,152

[22] Filed: Nov. 23, 1984

[51] Int. Cl.[4] ..... A63B 21/04

[52] U.S. Cl. ..... 272/136; 272/142; 272/143; 272/900; 273/26 B

[58] Field of Search ..... 272/136, 137, 138, 139, 272/142, 143, 900; 273/26 B, 26 R, 35 R, 72 R, 191 B

[56] References Cited

U.S. PATENT DOCUMENTS 3,578,801 5/1971 Piazza ..... 273/26 B
3,618,942 11/1971 Bates ..... 273/26 B
4,274,631 6/1981 Hayazaki ..... 273/26 B
4,328,964 5/1982 Walls ..... 273/26 R

*Primary Examiner*—Richard J. Apley
*Assistant Examiner*—Robert W. Bahr
*Attorney, Agent, or Firm*—Edgar W. Averill, Jr.

[57] ABSTRACT

An exercising device having a bat which applies a restraint to the swinging thereof. This may be accomplished with an extendable line held therein or a moveable weight within the bat. The line is tied to a stationary object and as the bat is swung, a spring within the bat increases the resistance on the line. As the bat reaches the area at which it would normally contact the ball, the line is preferably restrained from further extension.

5 Claims, 14 Drawing Figures

24
23
12
21
10
22
17
18
19
20
13
11

4
4
23
24
12
13
10
20
17
18
19
22
21
11

11
10
19
17
24
21
13
20
22
12
23

12
23
13
10
22
20
24
15
16
14
21
d
13
17
19
18
11

26
25'
25
10
27
21
28

26
25
27
25'
28
10

26
25
25'
27
28
21
10
24

23
21
13
22
30
11
24
12
31

32
29
24
23
21
34
22
33
11

34
35
36
37
38
39
40
41
42
43
44
45
46
47
48
49
50
51
52
53
54
55
56
57
58
59
60
61
62

EXERCISING DEVICE

BACKGROUND OF THE DISCLOSURE

The field of the invention is exercising devices and the invention relates more particularly to devices useful for sports such as baseball utilizing a bat or other similar club or device which is swung.

In the building and training of muscles useful for improving the performance of the baseball player or other athlete, various callisthenics are typically used which strengthen muscles useful for improving hitting distance. One very beneficial exercise is the actual swinging of a bat against a pitched ball but unfortunately this is inefficient in that it requires both a pitcher and someone to retrieve the ball. Of course, batting cages and pitching machines have been devised which help reduce this problem but the expense of such devices is prohibitive for many amateur athletes. Also, even if available, only one batter can use the device at a time. There is thus a need for an exercising device which does not require the actual hitting of a ball or if hitting is done, it can be done in a smaller area and which can be made for a reasonable cost and which permits the exercising of the muscles used in the hitting of a ball.

SUMMARY OF THE INVENTION

It is an object of the present invention to provide an exercising device to strengthen the muscles of a ball player or other athlete.

The present invention is for an exercising device having bat means having a handle end and a tip. The bat means has a compartment longitudinally positioned therein, said compartment having a handle end and a tip end. Means for restraining the swinging of the bat are held within the compartment. The means for restraining may be done in two ways, the first way utilizing no external attachment and the second way utilizing a line affixed to a stationary object. This restraining means may be a moveable weight, a biased weight or a line extending out of the tip of the bat and affixed to biasing means within the bat. Biasing means having an internal end and an external end are affixed in the compartment with one end of the biasing means being affixed to the bat within the compartment. Line means are attached at one end to one end of the biasing means and the other end extends outside of the bat and is attachable to stationary holding means. Guide means are held by the bat means at the tip thereof and form a passageway between the tip end of the compartment and the exterior of the bat. When the line means is affixed to a stationary object, the bat may be swung and the biasing means creates an ever increasing resistance to the swing and stop means, slows and then completely stops the swing at a point which may be made to be the midpoint of the swing at which the ball is normally struck. Preferably, the spring is a helical spring which may be either compressed or extended by the outward movement of the lines means. The line means should move a distance of between 8 and 18 inches and preferably about 12 inches. Thus, the first method encompases using the same bat as above with the exception that no line extends out. Rather than having the objective to stop the bat completely, the objective with the first method is to centrifugally create more weight at the wide end of the bat.

DESCRIPTION OF THE PREFERRED EMBODIMENTS

Figure 1:
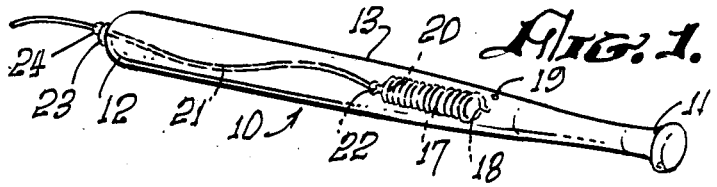
FIG. 1 is a perspective view, partially cut away, of the exercising device of the present invention.

An exercising device, more particularly a baseball bat, is shown in FIG. 1 and indicated by reference character 10. The bat has a handle end 11 and a tip 12 and a barrel portion 13 which is the area normally contacted by the baseball. Bat 10 has a hollowed out portion shown best in FIG. 4 which hollowed out portion forms a compartment 14 which has a handle end 15 and a tip end 16.

Biasing means shown in FIGS. 1 through 4 as a helical spring 17 is affixed at its internal end 18 to a pin 19 which is held by bat 10. The external end 20 of spring 17 is affixed to a line or cable 21. Line 21 may be a nylon or other polymeric or natural fiber line or instead may be a metal woven cable. It is important that line 21 be of high strength and capable of withstanding a relatively sharp bend without undue wear or breaking. Line 21 has a stop means comprising a ball-stop 22 which cooperates with a guide means 23. Ball-stop 22 is of such a size and shape so that it is stopped when it contacts the guide means or grommet 23. A second stop means comprising ball-stop 24 prevents the line 21 from being pulled too far back into compartment 14.

Figure 5:
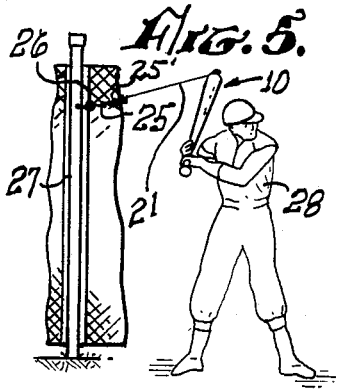
FIG. 5 is a side view of a batter using the exercising device of FIG. 1.
Figure 6:
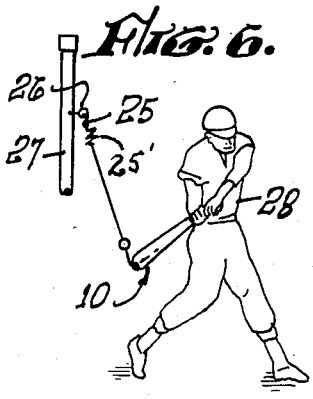
FIG. 6 is a side view of a batter using the exercising device of FIG. 1.
Figure 7:
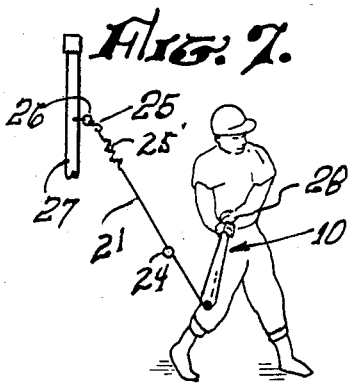
FIG. 7 is a side view of a batter using the exercising device of FIG. 1.

The device is used in the manner shown in FIGS. 5, 6 and 7. Line 21 may have a snap or hook 25 to facilitate its attachment onto a stationary holding member such as pole 27 which may be equipped with an eye 26. A second spring 25' can be attached to the snap or hook end of the line 21 to provide stress relief by preventing an abrupt stop. Alternatively, the snap may be such that it could be attached to a chain link back stop of the type commonly used on baseball fields. One particular advantage of the exercising device of the present invention is its ease of use in many locations. Line 21 can be attached to almost any stationary objects such as a tree, fence post or the like.

In use, as shown in FIG. 5, batter 28 stands in a normal batting stance. Line 21 is affixed at its terminous end to pole 27. Preferably, ball is pitched to batter 28 and a normal swing is made as shown in FIGS. 6 and 7. At the point as shown in FIG. 7 where the bat contacts the ball, line 21 is fully extended from compartment 14 and further travel of the bat is prevented by the contact of ball-stop 22 against grommet 23 and the spring 25'. By stopping the line at this point, the muscles used during the swing are strengthened as they attempt to work against the restrained bat. Furthermore, the batter is trained to keep his eye on the ball and is better able to observe the position of the bat at the hitting position. Of course, the exercising device can be used without the presence of a pitcher.

Figure 2:
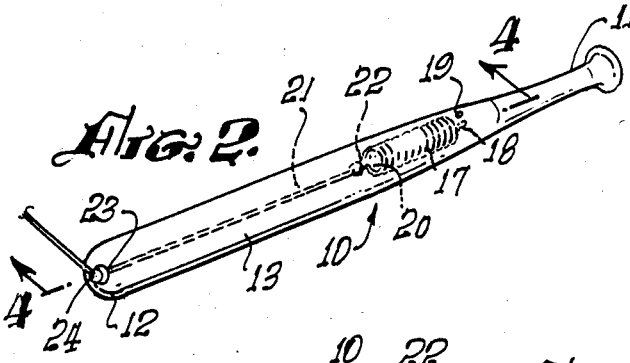
FIG. 2 is a perspective view, partially cut away, of the exercising device of FIG. 1.
Figure 3:
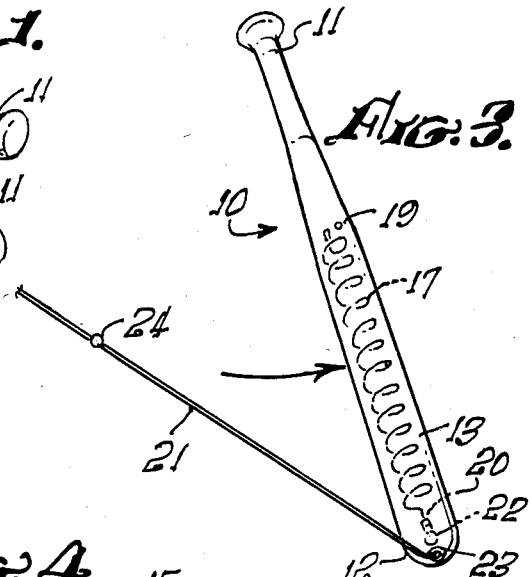
FIG. 3 is a perspective view, partially cut away, of the exercising device of FIG. 1 with the spring thereof at maximum extension.

The movement of the spring inside the bat is shown best by a comparison of FIGS. 2 and 3. In FIG. 2, spring 17 is in its relaxed configuration. As the bat is moved through the arc of a swing, spring 17 is extended thereby increasing its resistance as the swing progresses until the point of full extension shown in FIG. 3 where ball 22 contacts grommet 23. In this instance, the spring action in the bat compartment is completed. However, the final spring action which brings the bat to a stop is accomplished by the outer spring 25' which is attached to line 21 several inches before the snap or hook 25.

Figure 4:
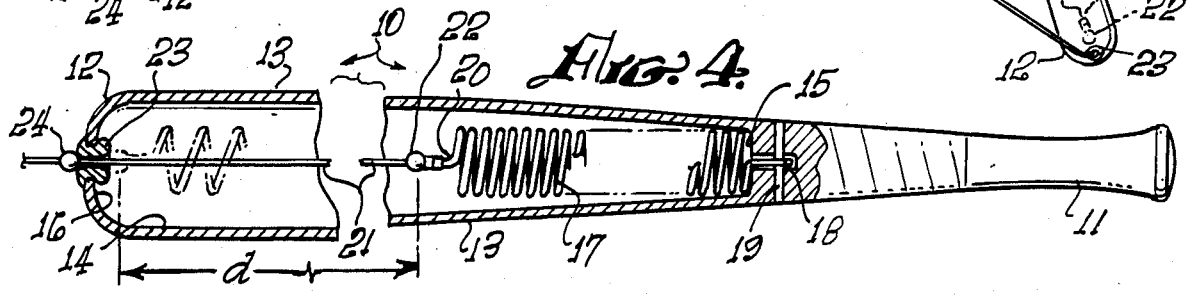
FIG. 4 is a cross-sectional view taken along line 4—4 of FIG. 2.

The amount of movement together with the predetermined stopping of the extension of line 21 forms an important part of the present invention and the amount of movement is indicated by reference character "d" in FIG. 4. This amount of movement should be between 8 and 18 inches and preferably about 12 inches to provide an appropriate amount of movement to cause the bat to stop at the hitting position. A certain amount of slack may be provided by the batter 28 moving closer to pole 27 to bring about the appropriate stopping point for the swing.

Figure 8:
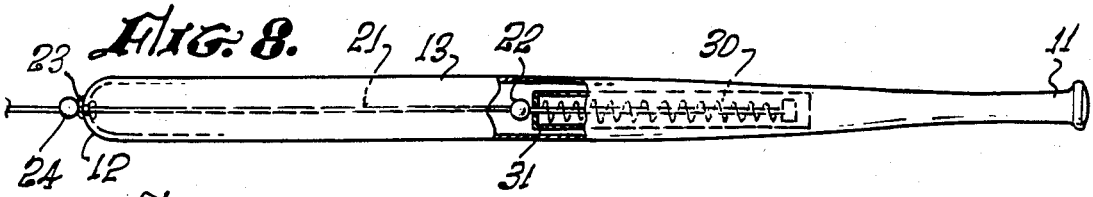
FIG. 8 is a side view, partially cut away, of an alternate embodiment of the exercising device of FIG. 1.
Figure 9:
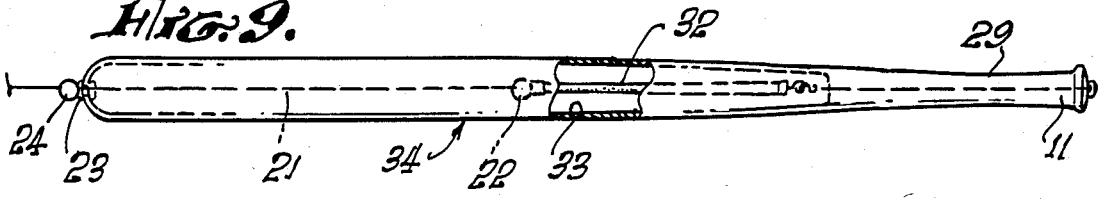
FIG. 9 is a side view, partially cut away, of an alternate embodiment of the exercising device of FIG. 1.

Other internal constructions are possible such as those indicated in FIGS. 8 and 9. In FIG. 8, the spring is extended in its relaxed configuration and upon outward movement of line 21, spring 30 is compressed rather than extended as shown above. Spring 30 is retained in a tube 31 held within bat 10. Rather than affixing the biasing means by a pin such as pin 19 of FIG. 4, it may alternatively be affixed by a pin 29 which is longitudinally positioned so that it extends through the center of the handle to the handle end 11.

The biasing means need not be a helical spring but instead could be an elastic cord such as shown in FIG. 9 where elastic cord 32 is held within a compartment 33 in bat 34.

The bat may be fabricated from aluminum or other alloy or material of sufficient strength and weight so that it may withstand the shock of impact with a baseball. For those uses where the bat need not contact a ball as for instance as it is used only for exercising and not in conjunction with a pitched ball, it could be made from ash.

The length of the line which extends past ball 24 is not critical but the line should be long enough so that the user can stand far enough away from a stationary object so that it does not interfere with his swing. Approximately 5 to 8 feet is usually appropriate. Another advantage of the use of the device of the present invention in conjunction with a pitched ball is that the restraining of the bat decreases the distance of which a ball is hit and facilitates its return. This permits more players to participate in batting practice at any one time.

Figures 10, 11, 12, 13, 14:
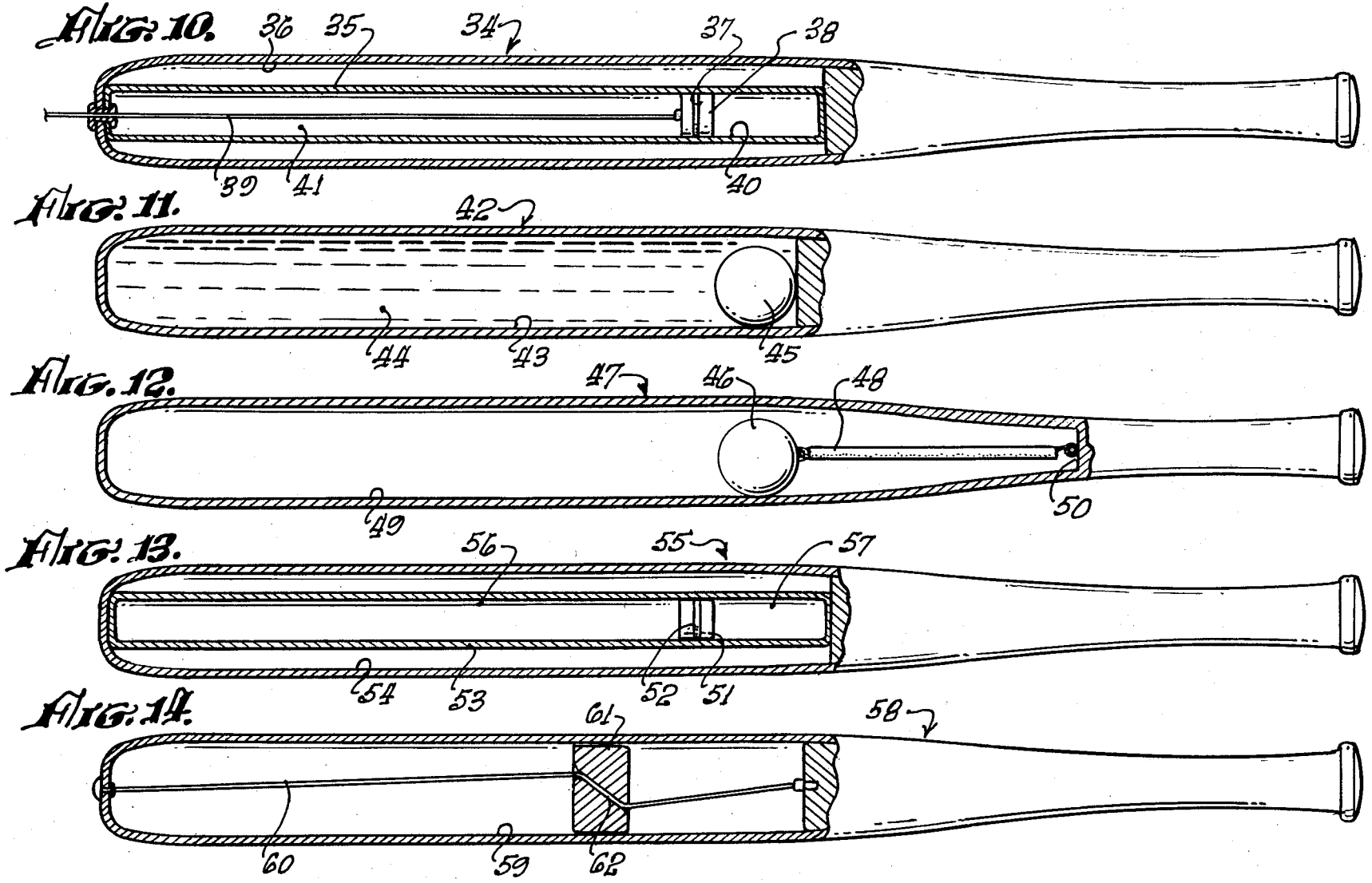
FIG. 10 is a side view, partly in cross section of an alternate embodiment of the bat of the present invention.
FIG. 11 is a side view, partly in cross section of an alternate embodiment of the bat of the present invention.
FIG. 12 is a side view, partly in cross section of an alternate embodiment of the bat of the present invention.
FIG. 13 is a side view, partly in cross section of an alternate embodiment of the bat of the present invention.
FIG. 14 is a side view, partly in cross section of an alternate embodiment of the bat of the present invention.

The biasing may be provided by the compression or expansion of air as shown in FIG. 10. In FIG. 10, a steel cylinder 35 is longitudinally held in compartment 36. A piston 38 has an O-ring or Teflon seal 37 to form an airtight seal with the interior wall of cylinder 35. A line 39 is affixed to piston 38 and as the line is moved outwardly, the air space 40 is expanded and air space 41 is compressed. This results in a resistance against swinging and provides the appropriate exercise.

An alternate method of causing a resistance to swinging is the provision of a weight which moves outwardly along the bat as the bat is swung. As shown in FIG. 11, bat 42 has a compartment 43 which is filled with oil 44. Steel ball 45 which should weigh about one pound is held within oil bath 44 and moves outwardly as the bat is swung providing a resistance to swinging.

A steel ball 46 is shown in bat 47 in FIG. 12. Compartment 49 is merely filled with air and a rubber cord or spring 48 holds ball 46 near the handle end 50 of compartment 49. FIG. 13 shows a steel piston 51 having a Teflon ring 52 which fits snugly within steel cylinder 53. Steel cylinder 53 is longitudinally held within compartment 54. As the bat 55 is swung, steel piston 51 moves outwardly against the increasing pressure of air in air space 56 and also against the partial vacuum in air space 57.

Lastly, as shown in FIG. 14, bat 58 has a compartment 59 in which line 60 is longitudinally affixed in a secure manner. A steel cylinder 61 is slideable within compartment 59 and has an angled hole or passageway 62. As bat 58 is swung, steel cylinder 61 moves outwardly within compartment 59 and is restrained during its movement by the friction of line 60 against angled passageway 62.

While the present invention has been discussed in conjunction with a baseball bat, it may be used in other games which require the swinging of a club or racket. The device may be made at reasonable costs so that it can be purchased by any serious baseball player. It tends to develop strength in the muscles which are directly related to the art of hitting a ball. It also assists the batter to develop what is known as a "quick bat" which results from the strengthening of the hands and wrists from the use of the present device. Another advantage is that the batter's eyes would tend to stop at point of contact with the ball where the bat would stop thereby helping to train the user to keep his eye on the ball. The bat also can, of course, be used indoors in inclement weather.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An exercising device comprising:

bat means having a handle end and a tip, said bat means having a compartment longitudinally positioned therein, said compartment having a handle end and a tip end;

biasing means having a first and second end, said biasing means being affixed at the first end to the bat means at one end of the compartment and being held completely within said compartment;

inelastic line means having a bat end and an external end, the bat end of the line means being attached to the second end of said biasing means and being attachable at its external end to stationary holding means; and guide means held by said bat means at the tip thereof, said guide means forming a passageway between the tip end of said compartment and the exterior of said bat, said guide means surrounding said line means.

2. The exercising device of claim 1, wherein said biasing means is affixed at its first end to the handle end of said compartment, and the bat end of said inelastic line means is affixed to the second end of said biasing means.

3. The exercising device of claim 1 further including a ball stop affixed to the inelastic line means at its point of connection with said biasing means, said ball stop being of a size and shape so that it is stopped when it contacts said guide means.

4. The exercising device of claim 1 wherein said line means travels a distance of about 8 to 18 inches.

5. The exercising device of claim 1 wherein said line means travels a distance of about 12 inches.

* * * * *